US009601836B2

(12) United States Patent
Liu et al.

(10) Patent No.: US 9,601,836 B2
(45) Date of Patent: Mar. 21, 2017

(54) FRONT FEED MICROWAVE ANTENNA

(75) Inventors: Ruopeng Liu, Shenzhen (CN); Chunlin Ji, Shenzhen (CN); Yutao Yue, Shenzhen (CN); Xiaoming Yin, Shenzhen (CN)

(73) Assignee: KUANG-CHI INNOVATIVE TECHNOLOGY LTD., Shenzhen (CN)

( * ) Notice: Subject to any disclaimer, the term of this patent is extended or adjusted under 35 U.S.C. 154(b) by 441 days.

(21) Appl. No.: 14/235,079

(22) PCT Filed: Nov. 24, 2011

(86) PCT No.: PCT/CN2011/082820

§ 371 (c)(1),
(2), (4) Date: May 24, 2014

(87) PCT Pub. No.: WO2013/013462

PCT Pub. Date: Jan. 31, 2013

(65) Prior Publication Data

US 2014/0320361 A1 Oct. 30, 2014

(30) Foreign Application Priority Data

Jul. 26, 2011 (CN) ..... 2011 1 0210400
Jul. 26, 2011 (CN) ..... 2011 1 0210421

(51) Int. Cl.
*H01Q 19/10* (2006.01)
*H01Q 19/06* (2006.01)
(Continued)

(52) U.S. Cl.
CPC ..... *H01Q 19/06* (2013.01); *H01Q 15/0086* (2013.01); *H01Q 15/10* (2013.01);
(Continued)

(58) Field of Classification Search
CPC ..... H01Q 15/02; H01Q 19/065
USPC ..... 343/753, 909, 757, 761, 782; 375/338; 775/339.05, 482.1, 503.1; 359/642, 620, 359/321, 341.32, 586, 652
See application file for complete search history.

(56) References Cited

U.S. PATENT DOCUMENTS 4,905,014 A 2/1990 Gonzalez et al.
5,661,499 A * 8/1997 Epshtein ..... H01Q 15/08 343/909
(Continued)

FOREIGN PATENT DOCUMENTS

CN 85200216 U 1/1986
CN 1050470 A 4/1991
(Continued)

*Primary Examiner* — Graham Smith
*Assistant Examiner* — Jae Kim
(74) *Attorney, Agent, or Firm* — Perkins Coie LLP

(57) ABSTRACT

A front feed microwave antenna, which comprises a radiation source, a first metamaterial panel used for radiating an electromagnetic wave emitted by the radiation source, a second metamaterial panel, and a reflective panel affixed to the back of the first metamaterial panel. The electromagnetic wave is emitted via the first metamaterial panel, refracted by entering the second metamaterial panel, reflected by the reflective panel, and finally re-refracted by reentering the second metamaterial panel, then finally parallel-emitted.

15 Claims, 9 Drawing Sheets

(51) Int. Cl.
*H01Q 15/00* (2006.01)
*H01Q 15/10* (2006.01)
*H01Q 15/23* (2006.01)

(52) U.S. Cl.
CPC ..... *H01Q 15/23* (2013.01); *H01Q 19/065* (2013.01); *H01Q 19/10* (2013.01)

(56) References Cited

U.S. PATENT DOCUMENTS

| | | | | |
|---|---|---|---|---|
| 6,151,168 | A * | 11/2000 | Goering ..... | G02B 27/09 359/623 |
| 6,351,247 | B1 | 2/2002 | Linstrom et al. | |
| 2010/0067091 | A1* | 3/2010 | Smith ..... | B82Y 20/00 359/278 |
| 2011/0199281 | A1* | 8/2011 | Morton ..... | H01Q 1/42 343/872 |

FOREIGN PATENT DOCUMENTS

| | | | |
|---|---|---|---|
| CN | 101587990 | A | 11/2009 |
| CN | 101877436 | A | 11/2010 |

* cited by examiner

FRONT FEED MICROWAVE ANTENNA

TECHNICAL FIELD

The present invention relates to the field of antennas, and in particular, to a feed-forward microwave antenna.

BACKGROUND

A feed-forward microwave antenna in the prior art is generally formed of a metal paraboloid and an emission source located at a focus of the metal paraboloid, where the metal paraboloid serves a purpose of reflecting an external electromagnetic wave to the emission source or reflecting an electromagnetic wave emitted by the emission source to outside. An area of the metal paraboloid and the processing precision of the metal paraboloid directly decide various parameters of the microwave antenna, such as gain and directivity.

However, the feed-forward microwave antenna in the prior art has the following shortcomings: one is that a part of electromagnetic waves reflected by the metal paraboloid is blocked by the emission source which leads to a certain energy loss, and another one is that the metal paraboloid is difficult to manufacture and costly. The metal paraboloid is generally die-cast by using a mold or is processed by using a CNC machine tool. The procedure of the first method includes: making a paraboloidal mold, die-casting a paraboloid, and mounting a paraboloidal reflective panel. The procedure is complicated and costly, and the shape of the paraboloid needs to be accurate enough to implement directional propagation of the antenna, which hence imposes high requirements on processing precision. The second method uses a large CNC machine tool to process the paraboloid, and edits a program to control a path traveled by a knife tool in the CNC machine tool, so as to cut a desired paraboloidal shape. This method makes the cutting very precise, but it is difficult to manufacture such a large CNC machine tool, which is costly.

SUMMARY OF THE INVENTION

A technical problem to be solved by the present invention is: in view of technical shortcomings in the prior art, providing a feed-forward microwave antenna characterized by a small size, cost-effectiveness, high gain, and a long transmission distance.

A technical solution to the technical problem of the present invention is that a feed-forward microwave antenna is provided. The feed-forward microwave antenna includes an emission source, a first metamaterial panel configured for diverging an electromagnetic wave emitted by the emission source, a second metamaterial panel, and a reflective panel attached to a back side of the second metamaterial panel. The electromagnetic wave is diverged when passed through the first metamaterial, is refracted when passed through the second metamaterial panel, is reflected by the reflective panel, is refracted again when passed through the second metamaterial panel again and finally exits in parallel. The first metamaterial panel comprises a first substrate and a plurality of third artificial metal microstructures cyclically distributed on the first substrate or third artificial holes cyclically distributed in the first substrate. The second metamaterial panel comprises a core layer. The core layer comprises a plurality of core metamaterial sheet layers having the same refractive index distribution. Each core metamaterial sheet layer comprises a circular region whose circle center is a center of a substrate of the core metamaterial sheet layer, and a plurality of annular regions concentric with the circular region. Refractive indexes in the circular region change in the same range as that of refractive indexes of each of the annular regions. The refractive indexes decrease continuously from a maximum refractive index $n_p$ of the core metamaterial sheet layer to a minimum refractive index $n_0$ of the core metamaterial sheet layer with increase of the radius. The refractive indexes at the same radius are the same. The core metamaterial sheet layer comprises the substrate of the core metamaterial sheet layer and a plurality of first artificial metal microstructures distributed on a surface of the substrate of the core metamaterial sheet layer or a plurality of first artificial holes cyclically distributed in a surface of the substrate of the core metamaterial sheet layer.

Further, the second metamaterial panel further comprises a first graded metamaterial sheet layer to an $N^{th}$ graded metamaterial sheet layer that are symmetrically arranged on opposite sides of the core layer. The two $N^{th}$ graded metamaterial sheet layers, which are symmetrically arranged, both are adjacent to the core layer. Maximum refractive indexes of the first graded metamaterial sheet layer to the $N^{th}$ graded metamaterial sheet layer are $n_1$, $n_2$, $n_3$ . . . $n_n$ respectively, wherein $n_0<m<n_2<n_3< \ldots <n_n<n_p$. The maximum refractive index of the $a^{th}$ graded metamaterial sheet layer is $n_a$. The $a^{th}$ graded metamaterial sheet layer comprises a circular region whose circle center is a center of a substrate of the $a^{th}$ graded metamaterial sheet layer, and a plurality of annular regions concentric with the circular region. Refractive indexes in the circular region change in the same range as that of refractive indexes in each of the annular regions. The refractive index decreases continuously from a maximum refractive index $n_a$ of the $a^{th}$ graded metamaterial sheet layer to a same minimum refractive index $n_0$ shared by all graded metamaterial sheet layers and core metamaterial sheet layers with increase of the radius. The refractive indexes at the same radius are the same. Each graded metamaterial sheet layer comprises a substrate of graded metamaterial sheet layer, and a plurality of second artificial metal microstructures cyclically distributed on a surface of the substrate of the graded metamaterial sheet layer or a plurality of second artificial holes cyclically distributed in a surface of the substrate of the graded metamaterial sheet layer. All the graded metamaterial sheet layers and all the core metamaterial sheet layers make up a function layer of the second metamaterial panel.

Further, the second metamaterial panel further comprises a first matching layer to an $M^{th}$ matching layer that are symmetrically arranged on opposite sides of the function layer. The two $M^{th}$ matching layers, which are symmetrically arranged, both are adjacent to the first graded metamaterial sheet layer. Refractive indexes of the matching layers are distributed uniformly. The refractive index of the first matching layer adjacent to a free space is approximately equal to the refractive index of the free space. The refractive index of the $M^{th}$ matching layer adjacent to the first graded metamaterial sheet layer is approximately equal to a minimum refractive index $n_0$ of the first graded metamaterial sheet layer.

Further, an inner radius and an outer radius of each of the circular region and annular regions of each of the graded metamaterial sheet layers are respectively equal to those of each of the circular region and annular regions of each of the core metamaterial sheet layers. With change of the radius r, a relational expression of a refractive index distribution of each graded metamaterial sheet layer and each core metamaterial sheet layer is:

$$n_i(r) = \frac{i*n_p}{N+1} - \left(\frac{i}{(N+1)*2d}\right)*\left(\sqrt{r^2+s^2} - \sqrt{L(j)^2+s^2}\right)*\frac{\left(n_p - \frac{N+1}{i}*n_0\right)}{n_p - n_0}$$

wherein, "i" respectively corresponding to the first graded metamaterial sheet layer to the $N^{th}$ graded metamaterial sheet layer is values 1 to N. "i" corresponding to all core metamaterial sheet layers is N+1. "s" is a vertical distance from the emission source to the first graded metamaterial sheet layer. "d" is a total thickness of the first graded metamaterial sheet layer to the $N^{th}$ graded metamaterial sheet layer and all core metamaterial sheet layers.

$$d = \frac{\lambda}{2(n_p - n_0)},$$

wherein λ is a working wavelength of the second metamaterial panel. L(j) represents an inner radius value of the circular region and the annular regions concentric with the circular region on the core metamaterial sheet layer and the graded metamaterial sheet layer. "j" represents a serial number of the region, wherein L(1) represents the first region, that is, the circular region, and L(1)=0.

Further, a dimensions change law of the first artificial metal microstructures cyclically distributed on the substrate of the core metamaterial sheet layer is as follows. The first artificial metal microstructures have the same geometric shape. The substrate of the core metamaterial sheet layer comprises a circular region whose circle center is a center of the substrate of the core metamaterial sheet layer, and a plurality of annular regions concentric with the circular region. The dimensions of the first artificial metal microstructures in the circular region change in the same range as that of the dimensions of the first artificial metal microstructures in each of the annular regions. The dimensions decrease continuously from maximum dimensions to minimum dimensions with increase of the radius. The dimensions of the first artificial metal microstructures at the same radius are the same Further, a first graded metamaterial sheet layer to a third graded metamaterial sheet layer are symmetrically arranged on opposite sides of the core layer. A dimension change law of the second artificial metal microstructures cyclically distributed on the substrate of the graded metamaterial sheet layer is as follows. The second artificial metal microstructures have the same geometric shape. The substrate of the graded metamaterial sheet layer comprises a circular region whose circle center is a center of the substrate of the graded metamaterial sheet layer, and a plurality of annular regions concentric with the circular region. In the circular region and the annular region, the dimensions of the second artificial metal microstructures in the circular region change in the same range as that of the dimensions of the second artificial metal microstructures in each of the annular regions. The dimensions decrease continuously from maximum dimensions to minimum dimensions with increase of the radius. The dimensions of the second artificial metal microstructures at the same radius are the same.

Further, the first artificial holes are filled with a medium whose refractive index is less than that of the substrate of the core metamaterial sheet layer. A distribution law of the first artificial holes cyclically distributed in the substrate of the core metamaterial sheet layer is as follows. The substrate of the core metamaterial sheet layer comprises a circular region whose circle center is a center of the substrate of the core metamaterial sheet layer, and a plurality annular regions concentric with the circular region. The volumes of the first artificial holes in the circular region change in the same range as that of the volumes of the first artificial holes each of the annular regions. The dimensions increase continuously from minimum volumes to maximum volumes with increase of the radius. The volumes of the first artificial holes at the same radius are the same. Further, the medium is air.

Further, the second artificial holes are filled with a medium whose refractive index is less than that of the substrate of the graded metamaterial sheet layer. A distribution law of the second artificial holes cyclically distributed in the substrate of the graded metamaterial sheet layer is as follows. The substrate of the graded metamaterial sheet layer comprises a circular region whose circle center is a center of the substrate of the graded metamaterial sheet layer, and a plurality of annular regions concentric with the circular region. The volumes of the second artificial holes in the circular region change in the same range as that of the volumes of the second artificial holes in each of the annular regions. The volumes increase continuously from the minimum volume to the maximum volume with increase of the radius. The volumes of the second artificial holes are the same. Further, the medium is air.

Further, the first artificial metal microstructures, the multiple second artificial metal microstructures, and the third artificial metal microstructures have the same geometric shape.

Further, the geometric shape is an H shape, including an upright first metal branch and second metal branches located at two ends of the first metal branch and vertical to the first metal branch.

Further, the geometric shape also includes third metal branches respectively located at two ends of the second metal branches and perpendicular to the respective second metal branches.

Further, the geometric shape is a planar snowflake shape, including two first metal branches perpendicular to each other and second metal branches respectively located at two ends of the first metal branches and perpendicular to the respective first metal branches.

Further, refractive indexes of the first metamaterial panel are distributed in a circular shape whose circle center is a center point of the first metamaterial panel. The refractive index at the circle center has a minimum value. The refractive index corresponding to the radius increases with increase of the radius. The refractive index at the same radius is the same.

Further, the first metamaterial panel is formed of a plurality of first metamaterial sheet layers having the same refractive index distribution. The third artificial metal microstructures are distributed on the first substrate in a circular shape whose circle center is a center point of the first metamaterial panel. The dimensions of the third artificial metal microstructure at the circle center have the minimum values. The dimensions of the third artificial metal microstructure corresponding to the radius increase with increase of the radius. The dimensions of the third artificial metal microstructures at the same radius are the same.

Further, the first metamaterial panel is formed of a plurality of first metamaterial sheet layers having the same refractive index distribution. The third artificial holes are filled with a medium whose refractive index is less than that of the first substrate. A distribution law of the third artificial holes cyclically distributed in the first substrate is as follows. A center point of the first metamaterial panel serves as a circle center. The third artificial holes at the circle center have a maximum volume. The volumes of the third artificial holes at the same radius are the same. The volumes of the third artificial holes decrease with increase of the radius. Further, the medium is air.

Implementation of the technical solution of the present invention brings the following beneficial effects: by designing the refractive index change on a core layer and a graded layer of a metamaterial panel and between them, an electromagnetic wave emitted by an emission source is converted into a planar wave after being refracted twice, thereby improving convergence performance of the antenna, decreasing reflection loss significantly, avoiding decrease of electromagnetic energy, increasing the transmission distance, and improving antenna performance. Further, a metamaterial with a divergence function is arranged in front of the emission source, which increases the short-distance emission scope of the emission source, so that the overall dimensions of the feed-forward microwave antenna become less, and the electromagnetic wave reflected back by the core layer bypasses the emission source without generating any emission source shadow and causing energy loss. Further, an artificial metal microstructure or artificial pore structure to make up the metamaterial in the present invention, which brings beneficial effects of a simple process and low costs.

BRIEF DESCRIPTION OF DRAWINGS

The following describes the present invention in more detail with reference to accompanying drawings and embodiments. In the accompanying drawings.

DETAILED DESCRIPTION

Light is a type of electromagnetic wave. When light penetrates glass, because the wavelength of the light is far greater than the dimensions of an atom, we can describe a response of the glass to the light by using overall parameters of the glass such as a refractive index of the glass, rather than detailed parameters of the atoms that make up the glass. Correspondingly, in researching the response of a material to other electromagnetic waves, the response of any structure in the material to the electromagnetic wave may also be described by the overall parameters such as permittivity $\epsilon$ and permeability $\mu$ of the material, where the dimensions of the structure are far less than the wavelength of the electromagnetic wave. Through design of the structure at each point of the material, the permittivity and the permeability at each point of the material are the same or different, so that the overall permittivity and the overall permeability of the material are distributed regularly. The regularly distributed permeability and permittivity can cause the material to make a macro response to the electromagnetic wave, for example, converge the electromagnetic wave, diverge the electromagnetic wave, and the like. Such a material with regularly distributed permeability and permittivity is called metamaterial.

Figure 1:
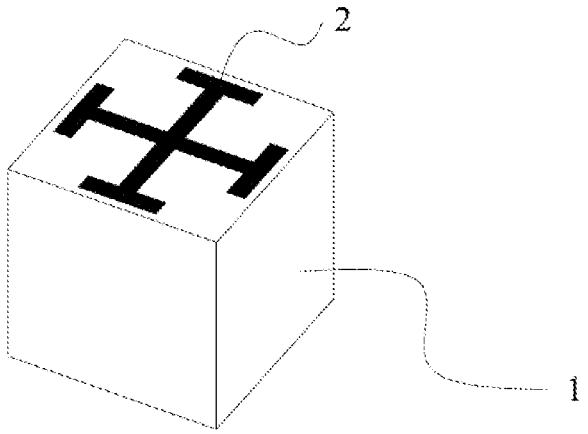
FIG. 1 is a schematic, isometric structural view of a basic unit that makes up a metamaterial according to a first embodiment of the present invention.

Referring to FIG. 1, a schematic, isometric structural diagram of a basic unit that makes up a metamaterial according to a first embodiment of the present invention is shown. The basic unit of the metamaterial includes an artificial microstructure 1 and a substrate 2 to which the artificial microstructure is attached. In the present invention, the artificial microstructure is an artificial metal microstructure. The artificial metal microstructure has a planar or three-dimensional topology structure that can respond to an electric field or a magnetic field of an incident electromagnetic wave. Once the pattern or dimensions of the artificial metal microstructure on each basic unit of the metamaterial is changed, the response of each basic unit of the metamaterial to the incident electromagnetic wave can be changed. When multiple basic units of the metamaterial are arranged according to a specific law, the metamaterial can make a macro response to the electromagnetic wave. Because the metamaterial as an entirety needs to have a macro electromagnetic response to the incident electromagnetic wave, responses made by the basic units of the metamaterial to the incident electromagnetic wave need to be continuous. This requires that the dimensions of each basic unit of the metamaterial are one-tenth to one-fifth of the incident electromagnetic wave, and preferably, one-tenth of the incident electromagnetic wave. In the description in this paragraph, the entirety of the metamaterial is imaginarily divided into a plurality of basic units of metamaterial. However, it should be noted that the division method is just for ease of description but does not mean that the metamaterial is spliced or assembled from multiple basic units of metamaterial. In practical application, the metamaterial is formed by distributing artificial metal microstructures on the substrate cyclically. The process is simple and the cost is low. Cyclic distribution means that the artificial metal microstructures on the basic units of metamaterial, into which are imaginarily divided, can generate continuous electromagnetic responses to the incident electromagnetic wave.

Figure 2:
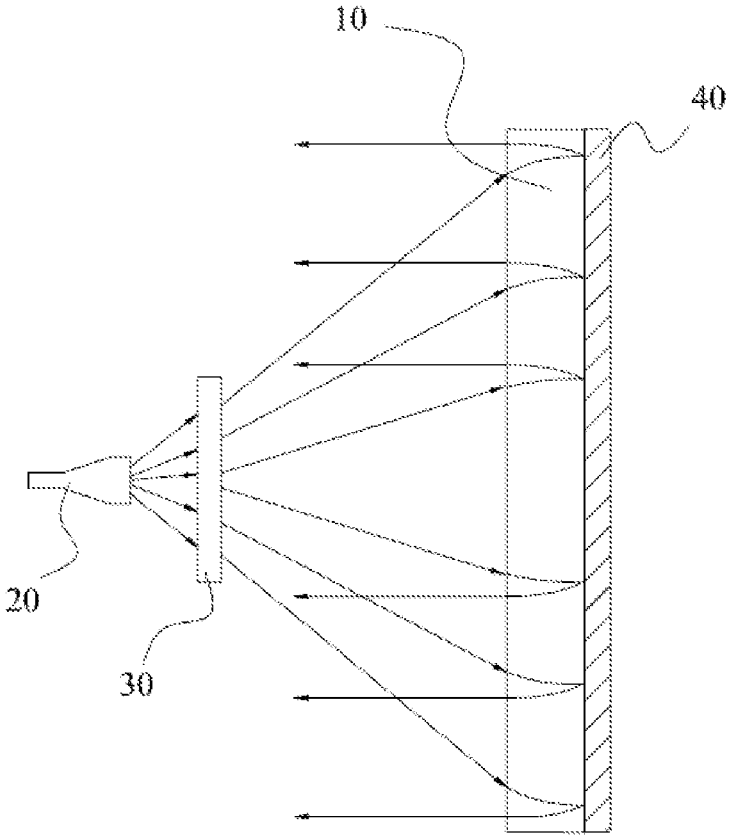
FIG. 2 is a schematic structural view of a feed-forward microwave antenna according to the first embodiment of the present invention.

Referring to FIG. 2, a schematic structural view of a feed-forward microwave antenna according to the first embodiment of the present invention is shown. In FIG. 2, the feed-forward microwave antenna of the present invention includes an emission source 20, a first metamaterial panel 30, a second metamaterial panel 10, and a reflective panel 40 located at a back side of the second metamaterial panel 10. In the present invention, frequencies of the electromagnetic waves emitted by the emission source 20 are in the range of 12.4 G Hertz to 18 G Hertz.

Figure 3:
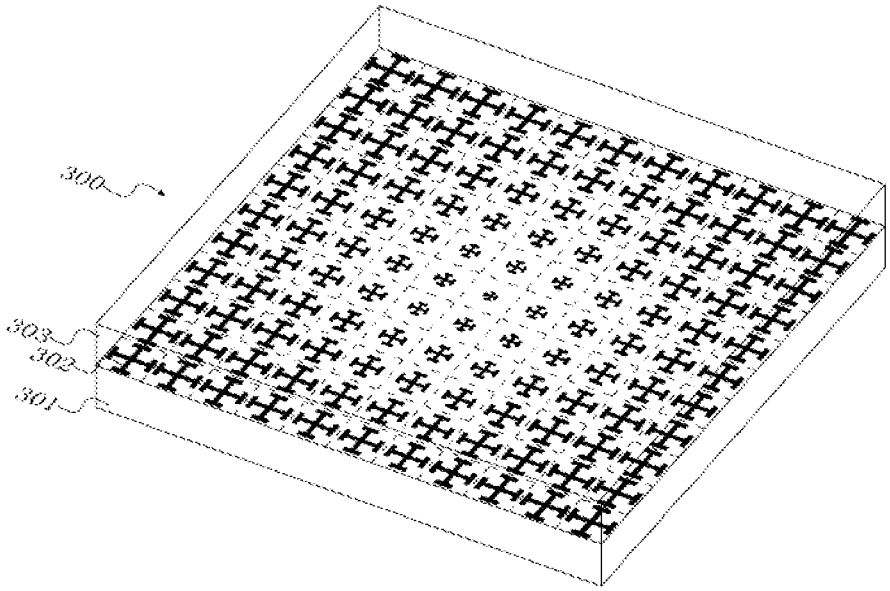
FIG. 3 is a schematic structural view of a first metamaterial sheet layer that makes up a first metamaterial panel in a feed-forward microwave antenna according to the first embodiment of the present invention.

The first metamaterial panel 30 may be directly attached to an emission port of the emission source 20. However, if the first metamaterial panel 30 is directly attached to the emission port of the emission source 20, a part of the electromagnetic wave emitted by the emission source 20 is reflected by the first metamaterial panel 30, which leads to energy loss. Therefore, in the present invention, the first metamaterial panel 30 is arranged in front of the emission source 20. The first metamaterial panel 30 is formed of a plurality of first metamaterial sheet layers 300 that have the same refractive index distribution. FIG. 3 is a schematic, isometric structural view of a first metamaterial sheet layer 300 according to the first embodiment of the present invention. To describe the first metamaterial sheet layer 300 clearly, FIG. 3 is drawn with inside visible seen from exterior. The first metamaterial sheet layer 300 includes a first substrate 301 and a plurality of third artificial metal microstructures 302 that are cyclically distributed on the first substrate. Preferably, the third artificial metal microstructures 302 are covered with an overlayer 303 so that the third artificial metal microstructures 302 are packaged. The overlayer 303 and the first substrate 301 have the same material and thickness. In the present invention, a thickness of each of the overlayer 303 and the first substrate 301 is 0.4 millimeter. A thickness of the artificial metal microstructure layer is 0.018 millimeter. Therefore, the overall thickness of the first metamaterial sheet layer is 0.818 millimeter.

The basic unit that makes up the first metamaterial sheet layer 300 is still shown in FIG. 1, and the first metamaterial sheet layer 300 needs to have an electromagnetic divergence function. According to electromagnetic principles, the electromagnetic wave is refracted to a direction having greater refractive indexes. Therefore, the change law of refractive indexes of the first metamaterial sheet layer 300 is: the refractive indexes of the first metamaterial sheet layer 300 are distributed in a circular shape whose circle center is a center point of the first metamaterial panel. The refractive index at the circle center has a minimum value, the refractive index corresponding to the radius increases with increase of the radius. At the same radius, the refractive indexes are same. The first metamaterial sheet layer 300 with such a refractive index distribution diverges the electromagnetic wave emitted by the emission source 20, thereby increasing the short-distance emission scope of the emission source, reducing the overall dimensions of the microwave antenna, and causing the electromagnetic wave reflected by the reflective panel not blocked by the emission source.

More specifically, in the present invention, the refractive index distribution law on the first metamaterial sheet layer 300 may be a linear change, that is, $n_{(R)}=n_{min}+KR$, where K is a constant, R is a straight-line distance from a center point of the basic unit of the metamaterial to a center point of the first substrate, where the basic unit of metamaterial is attached to by the third artificial metal microstructures distributed in a circular shape, and $n_{min}$ is a refractive index value of the first substrate at the center point thereof. In addition, the refractive index distribution law on the first metamaterial sheet layer 300 may also be a change according to a square law, that is, $n_{(R)}=n_{min}+KR^2$; or may be a change according to a cubic law, that is, $n_{(R)}=n_{min}+KR^3$; or may be a change according to a power function, that is, $n_{(R)}=n_{min}*K^R$. As seen from the change formulas of the first metamaterial sheet layer 300, it is appropriate only if the first metamaterial sheet layer 300 can diverge the electromagnetic wave emitted by the emission source.

Figure 4:
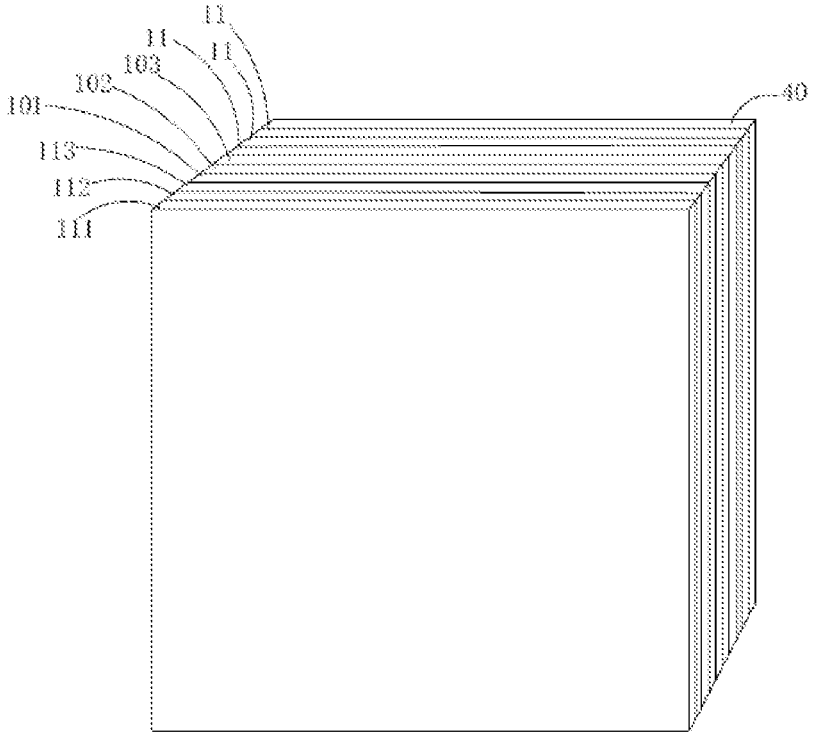
FIG. 4 is a schematic, isometric structural view of a second metamaterial panel in a feed-forward microwave antenna according to the first embodiment of the present invention.

The second metamaterial panel of the microwave antenna of the present invention is described in detail as following. The electromagnetic wave diverged by the first metamaterial panel is refracted when it is passed through the second metamaterial panel, and then is reflected by the reflective panel. The reflected electromagnetic wave is refracted again when it is passed through the second metamaterial panel again, so that the diverged spherical electromagnetic wave is emitted as a planar electromagnetic wave that is more suitable for long-distance transmission. Referring to FIG. 4, a schematic isometric structural view of a second metamaterial panel and a reflective panel according to the first embodiment of the present invention. In FIG. 4, the second metamaterial panel 10 includes: a core layer, where the core layer is formed of a plurality of core metamaterial sheet layers 11 with the same refractive index distribution; a first graded metamaterial sheet layer 101 to an $N^{th}$ graded metamaterial sheet layer that are arranged on both sides of the core layer, where the graded metamaterial sheet layers in this embodiment are the first graded metamaterial sheet layer 101, a second graded metamaterial sheet layer 102, and a third graded metamaterial sheet layer 103; and a first matching layer 111 to an $M^{th}$ matching layer that are arranged on both sides of the first graded metamaterial sheet layer 101, where refractive indexes of each matching layer 111 are distributed uniformly, the refractive index of the first matching layer 111 adjacent to a free space is approximately equal to a refractive index of the free space, and the refractive index of the last matching layer adjacent to the first graded metamaterial sheet layer 101 is approximately equal to a minimum refractive index of the first graded metamaterial sheet layer 101. The matching layer in this embodiment includes the first matching layer 111, a second matching layer 112, and a third matching layer 113. The graded metamaterial sheet layers and the matching layers can reduce electromagnetic wave reflection and have the effects of impedance matching and phase compensation. Therefore, arranging the graded metamaterial sheet layers and the matching layers is a preferred implementation manner.

The structure of the matching layer is similar to that of the first metamaterial sheet layer, is formed of an overlayer and a substrate, and differs from the first metamaterial sheet layer in that air is filled in a gap between the overlayer and the substrate. By changing the spacing between the overlayer and the substrate, the duty cycle of the air is changed, so that the matching layers have different refractive indexes.

The basic units that make up the core metamaterial sheet layer and the graded metamaterial sheet layer are shown in FIG. 1. In the present invention, in order to simplify the manufacturing process, the dimensions and the structure of the core metamaterial sheet layer and the graded metamaterial sheet layer are the same as those of the first metamaterial sheet layer. That is, an overlayer with 0.4 mm thick, a substrate with 0.4 mm thick, and artificial metal microstructures with 0.018 mm thick make up each core metamaterial sheet layer and each graded metamaterial sheet layer. Meanwhile, in the present invention, the first artificial metal microstructure, the second artificial metal microstructure and the third artificial metal microstructure, which respectively make up the core metamaterial sheet layer, the graded metamaterial sheet layer, and the first metamaterial sheet layer, have the same geometric shape.

The core metamaterial sheet layers and the graded metamaterial sheet layers each are divided into a circular region and a plurality of annular regions concentric with the circular region. With increase of the radius, the refractive indexes in each of the circular region and the annular regions decrease continuously from a maximum refractive index of the respective sheet layer to $n_0$. The refractive index values of the basic units of metamaterial located at the same radius is the same. The core metamaterial sheet layer has a maximum refractive index of $n_p$, and the maximum refractive indexes of the first graded metamaterial sheet layer to the $N^{th}$ graded metamaterial sheet layer are $n_1, n_2, n_3 \ldots n_p$, where $n_0<n_1<n_2<n_3 \ldots n_p<n_p$. An inner radius and an outer radius of each of the circular region and annular regions of each of the graded metamaterial sheet layers are respectively equal to those of each of the circular region and annular regions of each of the core metamaterial sheet layers. With change of the radius r, a refractive index distribution of each of the graded metamaterial sheet layers and core metamaterial sheet layers is:

$$n_i(r) = \frac{i*n_p}{N+1} - \left(\frac{i}{(N+1)*2d}\right)*\left(\sqrt{r^2+s^2} - \sqrt{L(j)^2+s^2}\right)*\frac{\left(n_p - \frac{N+1}{i}*n_0\right)}{n_p - n_0}$$

where, "i" corresponding to the first graded metamaterial sheet layer to the $N^{th}$ graded metamaterial sheet layer are values 1 to N, "i" corresponding to all core layers are N+1, "s" is a vertical distance from the emission source to the first graded metamaterial sheet layer; "d" is a total thickness of the first graded metamaterial sheet layer to the $N^{th}$ graded metamaterial sheet layer and all core metamaterial sheet layers, $$d = \frac{\lambda}{2(n_p - n_0)},$$

where λ is a working wavelength of the second metamaterial panel; the working wavelength of the second metamaterial panel is determined in practical application; as seen from the description about the metamaterial sheet layer, the thickness of each metamaterial sheet layer in this embodiment is 0.818 millimeters, and the "d" can be determined after the working wavelength of the second metamaterial panel is determined, so that the layer number of the metamaterial sheet layers in practical application is obtained; and L(j) represents an inner radius value of the circular region and the multiple annular regions concentric with the circular region on the core metamaterial sheet layer and the graded metamaterial sheet layer, and j represents a serial number of the region, where L(1) represents the first region, that is, the circular region, and L(1)=0.

A preferred method for determining L(j) is described as following. When the electromagnetic waves emitted by the emission source enter the first graded metamaterial sheet layer, due to different exit angles, the electromagnetic waves that enter the first graded metamaterial sheet layer travel different optical path lengths. The "s" is a vertical distance from the emission source to the first graded metamaterial sheet layer, and is also the shortest optical path length traveled by the electromagnetic wave that enters the first graded metamaterial sheet layer. In this case, the incident point corresponds to the inner radius of the circular region of the first graded metamaterial sheet layer, that is, when j=1, correspondingly L(1)=0. When an electromagnetic wave emitted by the emission source enters the first graded metamaterial sheet layer, the traveled optical path length is s+λ, a distance from the incident point of the electromagnetic wave to an incident point in the case of vertical incidence is an inner radius of the first annular region of the annular regions, and is also an outer radius of the circular region. According to the mathematic formula, when j=2, correspondingly $L(2)=\sqrt{(s+\lambda)^2-s^2}$, where λ is the wavelength value of the incident electromagnetic wave. When an electromagnetic wave emitted by the emission source enters the first graded metamaterial sheet layer, the traveled optical path length is s+2λ, a distance from the incident point of the electromagnetic wave to an incident point in the case of vertical incidence is an inner radius of the second annular region of the annular regions, and is also an outer radius of the first annular region. According to the mathematic formula, when j=3, correspondingly $L(3)=\sqrt{(s+2\lambda)^2-s^2}$. By analogy, the inner radius and the outer radius of the circular region and each annular region concentric with the circular region can be obtained.

Figure 5:
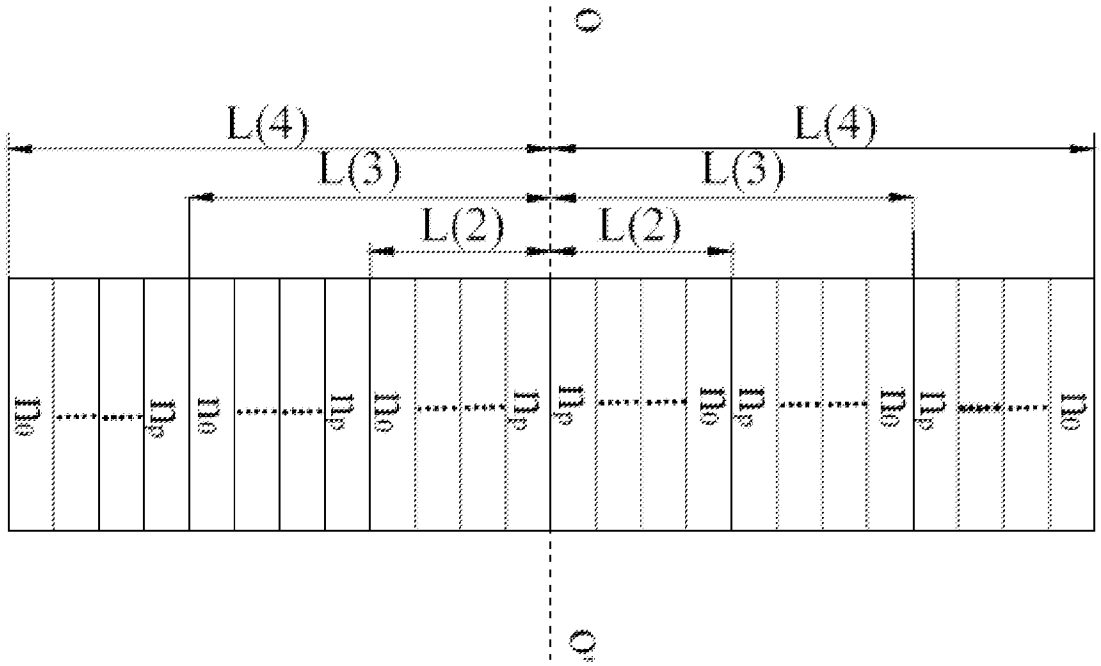
FIG. 5 is a schematic view of refractive index distribution of a core layer on a second metamaterial panel in a feed-forward microwave antenna varying with a radius according to the first embodiment of the present invention.

To express the change law more intuitively, a schematic diagram of refractive indexes of the core layer that vary with the radius on is shown in FIG. 5. In FIG. 5, the refractive index of each region changes gradually from $n_p$ to $n_0$, and the inner radius and the outer radius of each region are given according to the relational expression of L(j). FIG. 5 just shows the region change ranges of three regions, that is, L(2) to L(4), which, however, is merely illustrative. In practical application, the inner radius and the outer radius of any region can be derived by using L(j) as required. The schematic diagram of the refractive index of the graded layer, which changes with the radius, is similar to FIG. 5, and differs only in that the maximum value is not $n_p$, but is its own maximum refractive index value.

The above has described in detail the overall refractive index distribution relationship of the first metamaterial panel and the second metamaterial panel. According to principles of the metamaterial, it can be seen that the dimensions and the pattern of the artificial metal microstructures attached to the substrate directly determine the refractive index value of each point of the metamaterial. In addition, experiments show that, for the artificial metal microstructures with the same geometry, the greater the dimensions are, the greater the corresponding refractive index of the basic unit of metamaterial is. In the present invention, the first artificial metal microstructures, the second artificial metal microstructures, and the third artificial metal microstructures have the same geometric shape. Therefore, the distribution law of the third artificial metal microstructures on the first metamaterial sheet layer that makes up the first metamaterial panel is: the third artificial microstructures are the third artificial metal microstructures and have the same geometric shape; the third artificial metal microstructures on the first substrate are distributed in a circular shape whose circle center is a center point of the first substrate, the third artificial metal microstructure at the circle center have minimum dimensions, the dimensions of the third artificial metal microstructure corresponding to the radius increase with increase of the radius, and the dimensions of the third artificial metal microstructures are same at the same radius. The distribution law of the second artificial metal microstructures on the graded metamaterial sheet layer is: the second artificial metal microstructures have the same geometric shape; the substrate of the graded metamaterial sheet layer includes a circular region whose circle center is a center of the substrate of the graded metamaterial sheet layer, and a plurality of annular regions concentric with the circular region; the dimensions of the second artificial metal microstructures in the circular region change in the same range as that of the dimensions of the second artificial metal microstructures in each annular region, and, with increase of the radius, the dimensions decrease continuously from maximum dimensions to minimum dimensions, and the dimensions of the second artificial metal microstructures at the same radius are same. The distribution law of the first artificial metal microstructures on the core metamaterial sheet layer is: the first artificial metal microstructures have the same geometric shape, the substrate of the core metamaterial sheet layer includes a circular region whose circle center is a center of the substrate of the core metamaterial sheet layer, and a plurality of annular regions concentric with the circular region, the dimensions of the first artificial metal microstructures in the circular region change in the same range as that of the dimensions of the first artificial metal microstructures in each annular region, and, with increase of the radius, the dimensions decrease continuously from maximum dimensions to minimum dimensions, and the dimensions of the first artificial metal microstructures at the same radius are same.

The artificial metal microstructures that satisfy the refractive index distribution requirements of the first metamaterial panel and the second metamaterial panel described above have many types of geometric shapes, and they generally are geometric shapes that can respond to incident electromagnetic waves. Because it is difficult to change the magnetic field of the incident electromagnetic wave, most artificial metal microstructures currently available have the geometric shape that can respond to the electric field of the incident electromagnetic waves. A most typical one is an H-shaped artificial metal microstructure. Several geometric shapes of artificial metal microstructures are described in detail as following. According to the maximum refractive index and the minimum refractive index required by the first metamaterial panel and the second metamaterial panel, the dimensions of the artificial metal microstructure may be adjusted to meet requirements. The adjustment manner may be computer simulation or manual computing, which is not the essence of the present invention and is hence not detailed herein.

Figure 6:
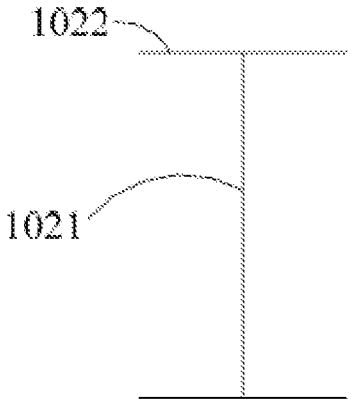
FIG. 6 is a geometric topology graph of a first preferred implementation manner of an artificial metal microstructure that can respond to an electromagnetic wave to change a refractive index of a basic unit of a metamaterial according to the first embodiment of the present invention.
Figure 7:
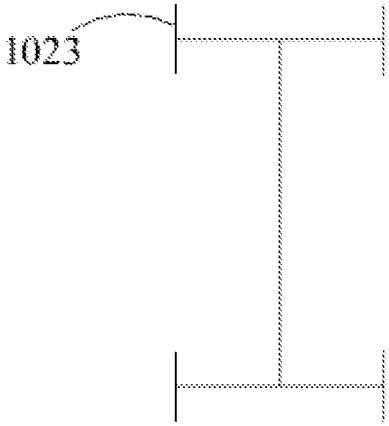
FIG. 7 is a derivative pattern of the geometric topology graph of the artificial metal microstructure in FIG. 6.

As shown in FIG. 6, a geometric topology graph of a first preferred implementation manner of an artificial metal microstructure that can respond to an electromagnetic wave to change a refractive index of a basic unit of a metamaterial according to the first embodiment of the present invention is shown. In FIG. 6, the artificial metal microstructure is H-shaped, including an upright first metal branch 1021, and second metal branches 1022 perpendicular to the first metal branch 1021 and respectively located at two ends of the first metal branch 1021. FIG. 7 is a derivative pattern of a geometric topology graph of the artificial metal microstructure in FIG. 6, where the artificial metal microstructure includes not only the first metal branch 1021 and the second metal branches 1022, but also third metal branches 1023 respectively, vertically arranged at both ends of each second metal branch.

Figure 8:
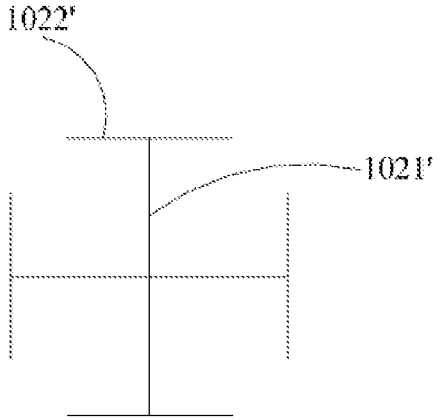
FIG. 8 is a geometric topology graph of a second preferred implementation manner of an artificial metal microstructure that can respond to an electromagnetic wave to change a refractive index of a basic unit of a metamaterial according to the first embodiment of the present invention.
Figure 9:
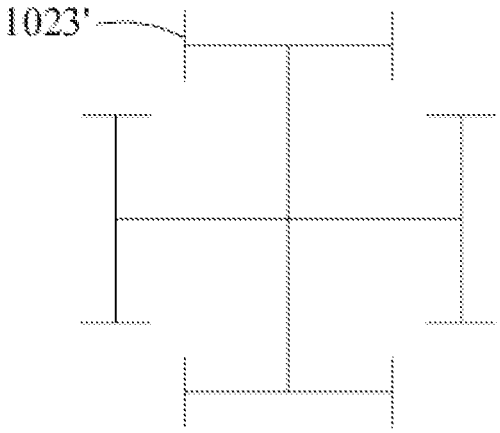
FIG. 9 is a derivative pattern of the geometric topology graph of the artificial metal microstructure in FIG. 8.

FIG. 8 is a geometric topology graph of a second preferred implementation manner of an artificial metal microstructure that can respond to an electromagnetic wave to change a refractive index of a basic unit of a metamaterial according to the first embodiment of the present invention. In FIG. 8, the artificial metal microstructure is a planar snowflake shape, which includes two first metal branches 1021' perpendicular to each other, and two second metal branches 1022' are respectively, vertically arranged at two ends of each of the two first metal branches 1021'. FIG. 9 is a derivative pattern of the geometric topology graph of the artificial metal microstructure in FIG. 8. It includes not only two first metal branches 1021' and four second metal branches 1022', but also two third metal branches 1023' respectively, vertically arranged at two ends of each of the four second metal branches. Preferably, the first metal branches 1021' have equal lengths and vertically intersect at the midpoint; the second metal branches 1022' have equal lengths and their midpoints are located at an endpoint of the respective first metal branch 1021; and the third metal branches 1023' have equal lengths and their midpoints are located at an endpoint of the respective second metal branch 1022'. The metal branches arranged in the above manner cause the artificial metal microstructures to be isotropic. That is, when the artificial metal microstructure is rotated 90° in any direction in a plane in which the artificial metal microstructure is located, the rotated artificial metal microstructure coincides with the original artificial metal microstructure. The application of the isotropic artificial metal microstructures can simplify design and reduce interference.

Figure 10:
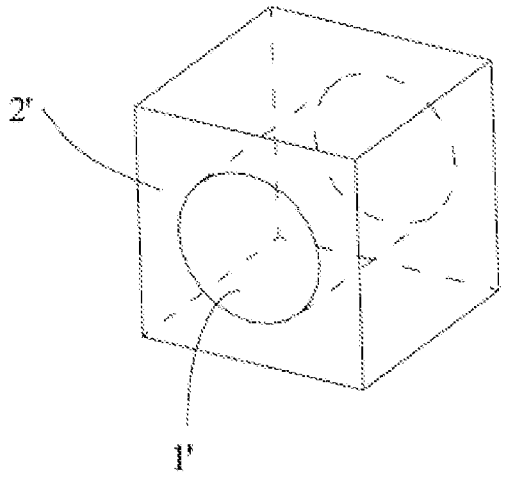
FIG. 10 is a three-dimensional schematic structural diagram of a basic unit that makes up a metamaterial according to Embodiment 2 of the present invention.

Referring to FIG. 10, a schematic isometric structural view of a basic unit that makes up a metamaterial according to a second embodiment of the present invention is shown. The basic unit of the metamaterial includes a substrate 2' and a plurality of artificial holes 1' defined in the substrate 2'. The artificial holes 1' defined in the substrate 2' cause the permittivity and the permeability at each point of the substrate 2' to vary with the volume of the artificial holes 1', so that each basic unit of the metamaterial has a different electromagnetic response to the incident wave with a same frequency. When the basic units of the metamaterial are arranged according to a specific law, the metamaterial can make a macro response to the electromagnetic wave. Because the metamaterial as an entirety needs to have a macro electromagnetic response to the incident electromagnetic wave, responses made by the basic units of the metamaterial to the incident electromagnetic wave need to be continuous. This requires that the dimensions of each basic unit of the metamaterial are one-tenth to one-fifth of the incident electromagnetic wave, and preferably, one-tenth of the incident electromagnetic wave. In the description in this paragraph, the metamaterial as an entirety is imaginary divided into a plurality of basic units of the metamaterial. However, it should be noted that the division method is just for ease of description but does not mean that the metamaterial is spliced or assembled by the basic units of the metamaterial. In practical application, the metamaterial is formed by cyclically defining artificial holes in the substrate, in which the process is simple and the cost is low. Cyclic distribution means that the artificial holes in the imaginarily divided basic units of the metamaterial above can make continuous electromagnetic responses to the incident electromagnetic wave.

Figure 11:
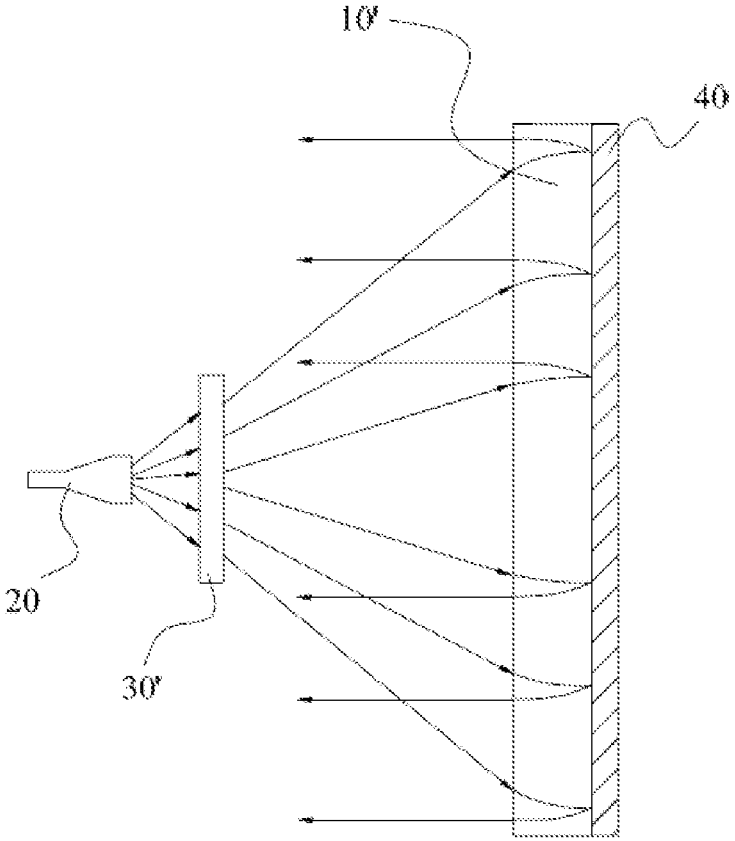
FIG. 11 is a schematic structural diagram of a feed-forward microwave antenna according to the second embodiment of the present invention.

Referring to FIG. 11, a schematic structural view of a feed-forward microwave antenna according to the second embodiment of the present invention is shown. In FIG. 11, the feed-forward microwave antenna in the present invention includes an emission source 20, a first metamaterial panel 30', a second metamaterial panel 10', and a reflective panel 40 located at a back side of the second metamaterial panel 10'. In the present invention, frequencies of the electromagnetic waves emitted by the emission source 20 are in the range of 12.4 G Hertz to 18 G Hertz.

Figure 12:
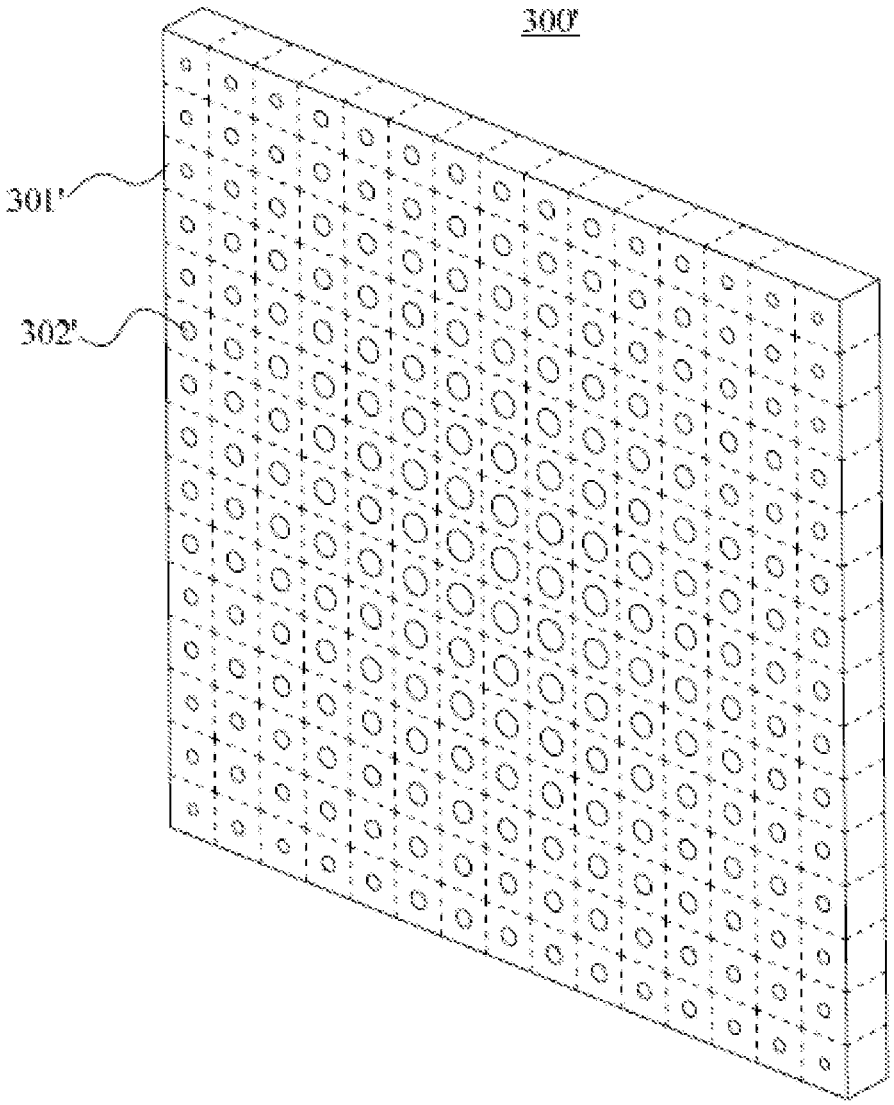
FIG. 12 is a schematic structural view of a first metamaterial sheet layer that makes up a first metamaterial panel in a feed-forward microwave antenna according to the second embodiment of the present invention.

The first metamaterial panel 30' may be directly attached to an emission port of the emission source 20. However, when the first metamaterial panel 30' is directly attached to the emission port of the emission source 20, a part of the electromagnetic wave emitted by the emission source 20 is reflected by the first metamaterial panel 30', which leads to energy loss. Therefore, in the present invention, the first metamaterial panel 30' is arranged in front of the emission source 20. The first metamaterial panel 30' is formed of a plurality of first metamaterial sheet layers 300' having the same refractive index distribution. Referring to FIG. 12, a schematic, isometric structural view of a first metamaterial sheet layer 300' according to the second embodiment of the present invention is shown. The first metamaterial sheet layer 300' includes a first substrate 301' and a plurality of third artificial holes 302' cyclically defined in the first substrate.

The basic unit that makes up the first metamaterial sheet layer 300' is still shown in FIG. 10, and the first metamaterial sheet layer 300' needs to have an electromagnetic divergence function. According to electromagnetic principles, the electromagnetic wave refracts to a direction having greater refractive indexes. Therefore, the change law of refractive indexes of the first metamaterial sheet layer 300' is: The refractive indexes of the first metamaterial sheet layer 300' are distributed in a circular shape, the refractive index at the circle center has the minimum value, the refractive index corresponding to the radius increases with increase of the radius, and the refractive indexes are same at the same radius. The first metamaterial sheet layer 300' with such a refractive index distribution diverges the electromagnetic wave emitted by the emission source 20, thereby increasing the short-distance emission scope of the emission source, reducing the overall dimensions of the feed-forward microwave antenna and causing the electromagnetic wave reflected by the reflective panel not blocked by the emission source.

More specifically, in the present invention, the refractive index distribution law on the first metamaterial sheet layer 300' may be linear change, that is, $n_{(R)}=KR$, where K is a constant, R is a straight-line distance from a center point of the basic unit of the metamaterial to a center point of the first substrate, where the basic unit of the metamaterial defines the third artificial holes distributed in a circular shape, and $n_{min}$ is a refractive index value at the center point of the first substrate. In addition, the refractive index distribution law of the first metamaterial sheet layer 300' may also be a change according to a square law, that is, $n_{(R)}=n_{min}+KR^2$; or may be a change according to a cubic law, that is, $n_{(R)}=n_{min}+KR^3$; or may be a change according to a power function, that is, $n_{(R)}=n_{min}*KR$. As seen from the change formulas of the first metamaterial sheet layer 300', it is appropriate only if the first metamaterial sheet layer 300' can diverge the electromagnetic wave emitted by the emission source.

Figure 13:
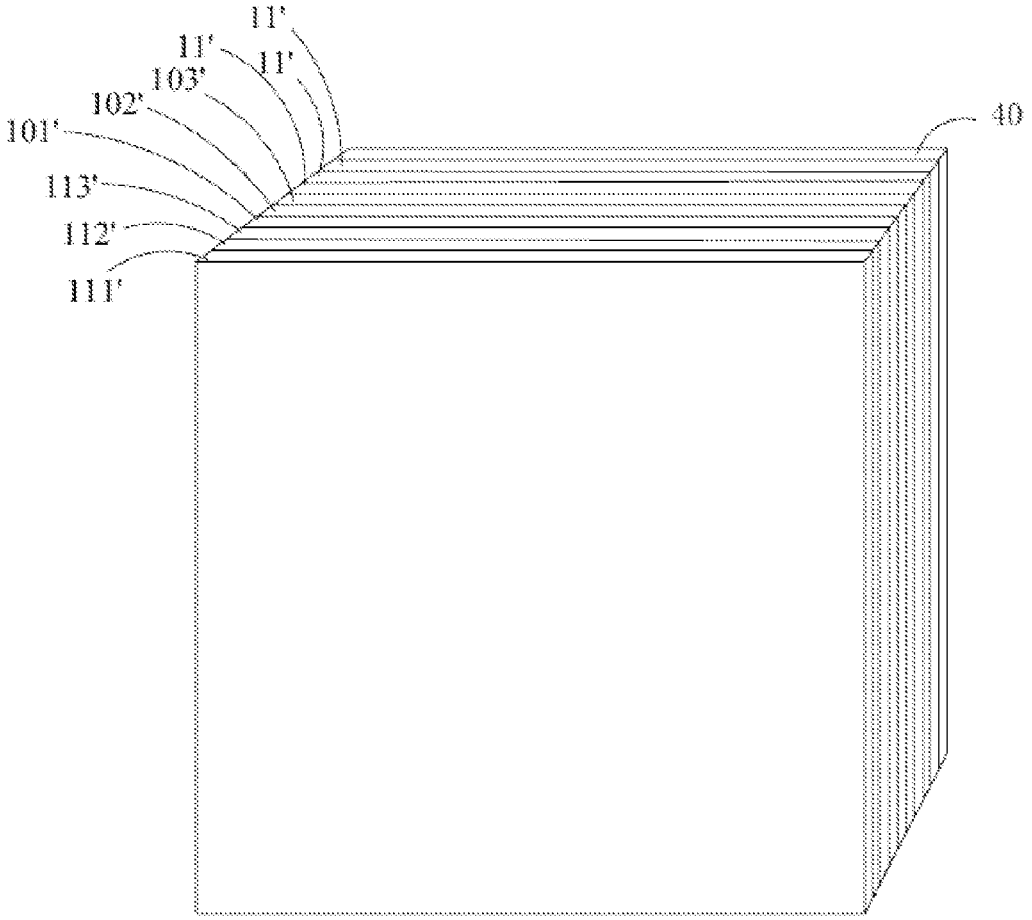
FIG. 13 is schematic, isometric structural view of a second metamaterial panel in a feed-forward microwave antenna according to the second embodiment of the present invention.

The second metamaterial panel of the feed-forward microwave antenna of the present invention is described in detail as following. The electromagnetic wave diverged by the first metamaterial panel is refracted when it is passed through the second metamaterial panel, and then is reflected by the reflective panel. The reflected electromagnetic wave is passed through the second metamaterial panel again and is refracted again, so that the diverged spherical electromagnetic wave is emitted as a planar electromagnetic wave that is more suitable for long-distance transmission. Referring to FIG. 13, a schematic, isometric structural view of a second metamaterial panel according to the second embodiment of the present invention is shown. In FIG. 13, the second metamaterial panel 10' includes: a core layer, and the core layer is formed of a plurality of core metamaterial sheet layers 11' with the same refractive index distribution; a first graded metamaterial sheet layer 101' to an $N^{th}$ graded metamaterial sheet layer arranged in front of the core layer, where the graded metamaterial sheet layers in this embodiment includes the first graded metamaterial sheet layer 101', a second graded metamaterial sheet layer 102', and a third graded metamaterial sheet layer 103; a first matching layer 111' to an $M^{th}$ matching layer arranged in front of the first graded metamaterial sheet layer 101', where refractive indexes of each matching layer are distributed uniformly, the refractive index of the first matching layer 111' adjacent to a free space is approximately equal to the refractive index of the free space, and the refractive index of the last matching layer adjacent to the first graded metamaterial sheet layer 101' is approximately equal to a minimum refractive index of the first graded metamaterial sheet layer 101'. The graded metamaterial sheet layers and the matching layers can reduce electromagnetic wave reflection and have the effects of impedance matching and phase compensation. Therefore, arrangement of the graded metamaterial sheet layers and the matching layers is a preferred implementation manner.

Figure 14:
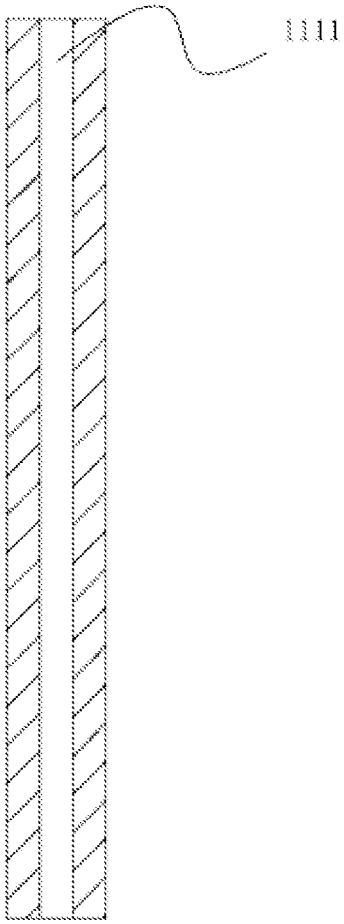
FIG. 14 is a sectional view of a matching layer of a second metamaterial panel in a feed-forward microwave antenna according to the second embodiment of the present invention.

In this embodiment, the matching layer is formed of sheet layers with a cavity 1111 therein. The greater the size of the cavity is, the less the refractive index of the sheet layers is. Gradual change of the size of the cavity causes a gradual change of the refractive index of each matching layer. A sectional view of the matching layer is shown in FIG. 14.

Basic units that make up the core metamaterial sheet layer and the graded metamaterial sheet layer are shown in FIG. 10.

The core metamaterial sheet layers and the graded metamaterial sheet layers each are divided into a circular region and multiple annular regions concentric with the circular region. The refractive indexes in the circular region and the annular region decrease continuously from a maximum refractive index of each sheet layer to $n_0$ with increase of the radius. The refractive index values of the basic unit of the metamaterial located at the same radius are equal. The core metamaterial sheet layer has a maximum refractive index of $n_p$. The maximum refractive indexes of the first graded metamaterial sheet layer to the $N^{th}$ graded metamaterial sheet layer are $n_1$, $n_2$, $n_3$ . . . $n_n$, where $n_0<n_1<n_2<n_3 \ldots n_n<n_p$. An inner radius and an outer radius of each of the circular region and annular regions of each of the graded metamaterial sheet layers are respectively equal to those of each of the circular region and annular regions of each of the core metamaterial sheet layers. With change of the radius r, a refractive index distribution of each of the graded metamaterial sheet layers and core metamaterial sheet layers is:

$$n_i(r) = \frac{i*n_p}{N+1} - \left(\frac{i}{(N+1)*2d}\right)*\left(\sqrt{r^2+s^2} - \sqrt{L(j)^2+s^2}\right)*\frac{\left(n_p - \frac{N+1}{i}*n_0\right)}{n_p - n_0}$$

where, "i" corresponding to the first graded metamaterial sheet layer to the $N^{th}$ Graded metamaterial sheet layer are values 1 to N, "i" corresponding to all core layers are N+1, "s" is a vertical distance from the emission source to the first graded metamaterial sheet layer; "d" is a total thickness of the first graded metamaterial sheet layer to the $N^{th}$ graded metamaterial sheet layer and all core metamaterial sheet layers, $$d = \frac{\lambda}{2(n_p - n_0)},$$

where λ is a working wavelength of the second metamaterial panel; the working wavelength of the second metamaterial panel is determined in practical application; as seen from the description about the metamaterial sheet layer, the thickness of each metamaterial sheet layer in this embodiment is 0.818 millimeters, and the "d" can be determined after the working wavelength of the second metamaterial panel is determined, so that the layer number of the metamaterial sheet layers in practical application is obtained; and L(j) represents an inner radius value of the circular region and the multiple annular regions concentric with the circular region on the core metamaterial sheet layer and the graded metamaterial sheet layer, and j represents a serial number of the region, where L(1) represents the first region, that is, the circular region, and L(1)=0.

A preferred method for determining L(j) is described as following. When the electromagnetic waves emitted by the emission source enter the first graded metamaterial sheet layer, due to different exit angles, the electromagnetic waves that enter the first graded metamaterial sheet layer travel different optical path lengths. The "s" is a vertical distance from the emission source to the first graded metamaterial sheet layer, and is also the shortest optical path length traveled by the electromagnetic wave that enters the first graded metamaterial sheet layer. In this case, the incident point corresponds to the inner radius of the circular region of the first graded metamaterial sheet layer, that is, when j=1, correspondingly L(1)=0. When an electromagnetic wave emitted by the emission source enters the first graded metamaterial sheet layer, the traveled optical path length is s+λ, a distance from the incident point of the electromagnetic wave to an incident point in the case of vertical incidence is an inner radius of the first annular region of the multiple annular regions, and is also an outer radius of the circular region. According to the mathematic formula, when j=2, correspondingly $L(2)=\sqrt{(s+\lambda)^2-s^2}$, where λ is the wavelength value of the incident electromagnetic wave. When an electromagnetic wave emitted by the emission source enters the first graded metamaterial sheet layer, the traveled optical path length is s+2λ, a distance from the incident point of the electromagnetic wave to an incident point in the case of vertical incidence is an inner radius of the second annular region of the multiple annular regions, and is also an outer radius of the first annular region. According to the mathematic formula, when j=3, correspondingly $L(3)=\sqrt{(s+2\lambda)^2-s^2}$. By analogy, the inner radius and the outer radius of the circular region and each of the annular regions concentric with the circular region can be obtained.

The foregoing change law can be seen from FIG. 5 in the preceding embodiment and the related description, and no repeated description is given here any further.

The above has described in detail the overall refractive index distribution relationship of the first metamaterial panel and the second metamaterial panel. According to principles of the metamaterial, it can be seen that the dimensions of the artificial holes in the substrate directly determine the refractive index value of each point of the metamaterial. In addition, experiments show that, when the artificial holes are filled with a medium whose refractive index is less than that of the substrate, the greater the size of the artificial pore structure is, the less the corresponding refractive index of the basic unit of the metamaterial is. In the present invention, the distribution law of the third artificial holes in the first metamaterial sheet layers that make up the first metamaterial panel is: the third artificial holes are filled with a medium whose refractive index is less than that of the first substrate, the basic units of the first metamaterial sheet layer are distributed on the first substrate in a circular shape whose circle center is a center point of the first substrate, the volumes of the third artificial hole in the basic unit of the first metamaterial sheet layer at which the circle center is located have a maximum value, the volumes of the third artificial hole increase with increase of the radius, and the volumes of the third artificial holes are same at the same radius. The distribution law of the second artificial holes in the graded metamaterial sheet layer is: the second artificial holes are filled with a medium whose refractive index is less than that of the substrate of the graded metamaterial sheet layer, the substrate of the graded metamaterial sheet layer includes a circular region whose circle center is a center point of the substrate of the graded metamaterial sheet layer, and a plurality of annular regions concentric with the circular region, the volumes of the second artificial holes in the circular region defined the basic units of the graded metamaterial sheet layer change in the same range as those of the second artificial holes in each of the annular regions defined in the basic units of the graded metamaterial sheet layer, the volumes of the second artificial holes defined in the basic units of the graded metamaterial sheet layer increase continuously from minimum dimensions to maximum dimensions with increase of the radius, and the volumes of the second artificial holes defined in the basic units of the graded metamaterial sheet layer at the same radius are the same. The distribution law of the first artificial holes on the core metamaterial sheet layer is: the first artificial holes are filled with a medium whose refractive index is less than that of the substrate of the core metamaterial sheet layer, the substrate of the core metamaterial sheet layer includes a circular region whose circle center is a center point of the substrate of the graded metamaterial sheet layer, and a plurality of annular regions concentric with the circular region, the volumes of the first artificial holes in the circular region defined in the basic units of the core metamaterial sheet layer change in the same range as that of the volumes of the first artificial holes in each of the annular regions defined in the basic units of the core metamaterial sheet layer, the volumes of the first artificial holes defined in the basic units of the core metamaterial sheet layer increase continuously from minimum dimensions to maximum dimensions with increase of the radius, and the volumes of the first artificial holes defined in the basic units of the core metamaterial sheet layer at the same radius are the same. The medium having a refractive index less than that of the substrate and stuffed in the first artificial hole, the second artificial hole, and the third artificial hole is air.

It can be inferred that, when the refractive index of the medium stuffed in the first artificial hole, the second artificial hole, and the third artificial hole is greater than that of the substrate, the distribution law of volumes of the artificial holes is contrary to the foregoing distribution law.

The shape of the artificial holes that satisfy the refractive index distribution requirements of the first metamaterial panel and the second metamaterial panel is not limited so long as the volumes of artificial holes defined in the basic units of the metamaterial satisfy the foregoing distribution law. In addition, a plurality of artificial holes with the same volume may also be formed in each basic unit of the metamaterial. In this case, the sum of dimensions of the artificial holes in each basic unit of the metamaterial needs to satisfy the foregoing distribution law.

Although the embodiments of the invention have been described with reference to accompanying drawings, the invention is not limited to the specific implementation manners. The specific implementation manners are merely illustrative rather than restrictive. As enlightened by the present invention, persons of ordinary skill in the art may derive many other implementation manners without departing from the ideas of the present invention and the protection scope of the claims of the present invention, which shall all fall within the protection scope of the present invention.

What is claimed is:

1. A feed-forward microwave antenna, comprising an emission source, a first metamaterial panel configured for diverging a spherical electromagnetic wave emitted by the emission source, a second metamaterial panel, and a reflective panel attached to a back side of the second metamaterial panel, the spherical electromagnetic wave being diverged when passed through the first metamaterial, being refracted when passed through the second metamaterial panel, being reflected by the reflective panel, being refracted again when passed through the second metamaterial panel again and finally exits as a planar electromagnetic wave; the first metamaterial panel comprising a first substrate and a plurality of third artificial metal microstructures cyclically distributed on the first substrate or third artificial holes cyclically distributed in the first substrate, configured to generate continuous electromagnetic responses to an incident electromagnetic wave; the second metamaterial panel comprising a core layer, the core layer comprising a plurality of core metamaterial sheet layers having the same refractive index distribution, each core metamaterial sheet layer comprising a circular region whose circle center is a center of a substrate of the core metamaterial sheet layer, and a plurality of annular regions concentric with the circular region, refractive indexes in the circular region changing in the same range as that of refractive indexes of each of the annular regions, the refractive indexes decreasing continuously from a maximum refractive index $n_p$ of the core metamaterial sheet layer to a minimum refractive index $n_0$ of the core metamaterial sheet layer with increase of the radius, the refractive indexes being the same at the same radius; and the core metamaterial sheet layer comprising the substrate of the core metamaterial sheet layer and a plurality of first artificial metal microstructures distributed on a surface of the substrate of the core metamaterial sheet layer or a plurality of first artificial holes cyclically distributed in a surface of the substrate of the core metamaterial sheet layer, wherein the second metamaterial panel further comprises a first graded metamaterial sheet layer to an $N^{th}$ graded metamaterial sheet layer that are symmetrically arranged on opposite sides of the core layer, wherein the two $N^{th}$ graded metamaterial sheet layers, which are symmetrically arranged, both are adjacent to the core layer; maximum refractive indexes of the first graded metamaterial sheet layer to the $N^{th}$ graded metamaterial sheet layer are $n_1$, $n_2$ $n_3$ . . . $n_n$ respectively, wherein $n_0<n_1<_2<n_3< \ldots <n_n<_p$; the maximum refractive index of the $a^{th}$ graded metamaterial sheet layer is $n_a$, the $a^{th}$ graded metamaterial sheet layer comprises a circular region whose circle center is a center of a substrate of the $a^{th}$ graded metamaterial sheet layer, and a plurality of annular regions concentric with the circular region, refractive indexes in the circular region change in the same range as that of each of the annular regions, the refractive index decreases continuously from a maximum refractive index $n_a$ of the $a^{th}$ graded metamaterial sheet layer to a same minimum refractive index $n_0$ shared by all graded metamaterial sheet layers and core metamaterial sheet layers with increase of the radius, and the refractive indexes are the same at the same radius; each graded metamaterial sheet layer comprises a substrate of graded metamaterial sheet layer, and a plurality of second artificial metal microstructures cyclically distributed on a surface of the substrate of the graded metamaterial sheet layer or a plurality of second artificial holes cyclically distributed in a surface of the substrate of the graded metamaterial sheet layer; and all the graded metamaterial sheet layers and all the core metamaterial sheet layers make up a function layer of the second metamaterial panel, wherein the second metamaterial panel further comprises a first matching layer to an $M^{th}$ matching layer that are symmetrically arranged on opposite sides of the function layer, wherein the two $M^{th}$ matching layers, which are symmetrically arranged, both are adjacent to the first graded metamaterial sheet layer; and refractive indexes of the matching layers are distributed uniformly, the refractive index of the first matching layer adjacent to a free space is approximately equal to the refractive index of the free space, and the refractive index of the $M^{th}$ matching layer adjacent to the first graded metamaterial sheet layer is approximately equal to a minimum refractive index $n_0$ of the first graded metamaterial sheet layer, wherein an inner radius and an outer radius of each of the circular region and annular regions of each of the graded metamaterial sheet layers are respectively equal to those of each of the circular region and annular regions of each of the core metamaterial sheet layers; and, with change of the radius r, a relational expression of a refractive index distribution of each graded metamaterial sheet layer and each core metamaterial sheet layer is:

$$n_i(r) = \frac{i * n_p}{N+1} - \left(\frac{i}{(N+1)*2d}\right) * \left(\sqrt{r^2+s^2} - \sqrt{L(j)^2+s^2}\right) * \frac{\left(n_p - \frac{N+1}{i} * n_0\right)}{n_p - n_0}$$

wherein, "i" respectively corresponding to the first graded metamaterial sheet layer to the $N^{th}$ graded metamaterial sheet layer is values 1 to N, "i" corresponding to all core metamaterial sheet layers is N+1, "s" is a vertical distance from the emission source to the first graded metamaterial sheet layer; "d" is a total thickness of the first graded metamaterial sheet layer to the $N^{th}$ graded metamaterial sheet layer and all core metamaterial sheet layers, $$d = \frac{\lambda}{2(n_p - n_0)},$$

wherein λ is a working wavelength of the second metamaterial panel; L(j) represents an inner radius value of the circular region and the annular regions concentric with the circular region on the core metamaterial sheet layer and the graded metamaterial sheet layer, and j represents a serial number of the region, wherein L(1) represents the first region, that is, the circular region, and L(1)=0.

2. The feed-forward microwave antenna according to claim 1, wherein a dimensions change law of the first artificial metal microstructures cyclically distributed on the substrate of the core metamaterial sheet layer is: the first artificial metal microstructures have the same geometric shape, the substrate of the core metamaterial sheet layer comprises a circular region whose circle center is a center of the substrate of the core metamaterial sheet layer, and a plurality of annular regions concentric with the circular region, and the dimensions of the first artificial metal microstructures in the circular region change in the same range as that of the dimensions of the first artificial metal microstructures in each of the annular regions, and the dimensions decrease continuously from maximum dimensions to minimum dimensions with increase of the radius, and the dimensions of the first artificial metal microstructures are the same at the same radius.

3. The feed-forward microwave antenna according to claim 1, wherein a first graded metamaterial sheet layer to a third graded metamaterial sheet layer are symmetrically arranged on opposite sides of the core layer, and a dimension change law of the second artificial metal microstructures cyclically distributed on the substrate of the graded metamaterial sheet layer is: the second artificial metal microstructures have the same geometric shape, the substrate of the graded metamaterial sheet layer comprises a circular region whose circle center is a center of the substrate of the graded metamaterial sheet layer, and a plurality of annular regions concentric with the circular region, and, in the circular region and the annular region, the dimensions of the second artificial metal microstructures in the circular region is change in the same range as that of the dimensions of the second artificial metal microstructures in each of the annular regions, and the dimensions decrease continuously from maximum dimensions to minimum dimensions with increase of the radius, and the dimensions of the second artificial metal microstructures are the same at the same radius.

4. The feed-forward microwave antenna according to claim 1, wherein the first artificial holes are filled with a medium whose refractive index is less than that of the substrate of the core metamaterial sheet layer, and a distribution law of the first artificial holes cyclically distributed in the substrate of the core metamaterial sheet layer is: the substrate of the core metamaterial sheet layer comprises a circular region whose circle center is a center of the substrate of the core metamaterial sheet layer, and a plurality annular regions concentric with the circular region, and the volumes of the first artificial holes in the circular region change in the same range as that of the volumes of the first artificial holes each of the annular regions, and the dimensions increase continuously from minimum volumes to maximum volumes with increase of the radius, and the volumes of the first artificial holes are the same at the same radius.

5. The feed-forward microwave antenna according to claim 4, wherein the medium is air.

6. The feed-forward microwave antenna according to claim 1, wherein the second artificial holes are filled with a medium whose refractive index is less than that of the substrate of the graded metamaterial sheet layer, and a distribution law of the second artificial holes cyclically distributed in the substrate of the graded metamaterial sheet layer is: the substrate of the graded metamaterial sheet layer comprises a circular region whose circle center is a center of the substrate of the graded metamaterial sheet layer, and a plurality of annular regions concentric with the circular region, and the volumes of the second artificial holes in the circular region change in the same range as that of the volumes of the second artificial holes in each of the annular regions, and the volumes increase continuously from the minimum volume to the maximum volume with increase of the radius, and the volumes of the second artificial holes are the same.

7. The feed-forward microwave antenna according to claim 6, wherein the medium is air.

8. The feed-forward microwave antenna according to claim 1, wherein the first artificial metal microstructures, the second artificial metal microstructures, and the third artificial metal microstructures have the same geometric shape.

9. The feed-forward microwave antenna according to claim 8, wherein the geometric shape is an H shape, comprising an upright first metal branch and second metal branches located at two ends of the first metal branch and vertical to the first metal branch.

10. The feed-forward microwave antenna according to claim 9, wherein the geometric shape further comprises third metal branches respectively located at two ends of the second metal branches and perpendicular to the respective second metal branches.

11. The feed-forward microwave antenna according to claim 8, wherein the geometric shape is a planar snowflake shape, comprising two first metal branches perpendicular to each other and second metal branches respectively located at two ends of the first metal branches and perpendicular to the respective first metal branches.

12. The feed-forward microwave antenna according to claim 1, wherein refractive indexes of the first metamaterial panel are distributed in a circular shape whose circle center is a center point of the first metamaterial panel, the refractive index at the circle center has a minimum value, the refractive index corresponding to the radius increases with increase of the radius, and the refractive indexes are the same at the same radius.

13. The feed-forward microwave antenna according to claim 12, wherein the first metamaterial panel is formed of a plurality of first metamaterial sheet layers having the same refractive index distribution, the third artificial metal microstructures are distributed on the first substrate in a circular shape whose circle center is a center point of the first metamaterial panel, the dimensions of the third artificial metal microstructure at the circle center have the minimum values, the dimensions of the third artificial metal microstructure corresponding to the radius increase with increase of the radius, and the dimensions of the third artificial metal microstructures are the same at the same radius.

14. The feed-forward microwave antenna according to claim 12, wherein the first metamaterial panel is formed of a plurality of first metamaterial sheet layers having the same refractive index distribution; the third artificial holes are filled with a medium whose refractive index is less than that of the first substrate, and a distribution law of the third artificial holes cyclically distributed in the first substrate is: a center point of the first metamaterial panel serves as a circle center, the third artificial holes at the circle center have a maximum volume, and the volumes of the third artificial holes at the same radius are the same, and the volumes of the third artificial holes decrease with increase of the radius.

15. The feed-forward microwave antenna according to claim 14, wherein the medium is air.

* * * * *